US005743180A

United States Patent [19]

Arnke

[11] Patent Number: 5,743,180

[45] Date of Patent: Apr. 28, 1998

[54] GOLF BALL MARKER

[76] Inventor: Michael C. Arnke, 805 B Valley View Dr., Pflugerville, Tex. 78660

[21] Appl. No.: 825,749

[22] Filed: Apr. 3, 1997

[51] Int. Cl.[6] ..... B41F 17/00

[52] U.S. Cl. ..... 101/35; 101/DIG. 40

[58] Field of Search ..... 101/35, 4, 28, 101/333, 327, 38.1, 41, DIG. 40

[56] References Cited

U.S. PATENT DOCUMENTS

| | | | |
|---|---|---|---|
| D. 249,089 | 8/1978 | Studley | D64/10 |
| 849,600 | 4/1907 | Cory | 101/4 |
| 952,501 | 3/1910 | Blumberg | 101/4 |
| 1,236,801 | 8/1917 | Willard | 101/35 |
| 1,286,205 | 12/1918 | Beaver | 101/4 |
| 1,527,691 | 2/1925 | McNab et al. | 101/5 |
| 1,537,685 | 5/1925 | Ladd | 10/4 |
| 1,814,170 | 4/1931 | Long | 101/35 |
| 2,539,303 | 1/1951 | Gerke et al. | 101/32 |
| 2,561,947 | 7/1951 | Premo | 101/4 |
| 4,086,851 | 5/1978 | Brandell | 101/4 |
| 4,803,922 | 2/1989 | Dennesen | 101/DIG. 40 |
| 4,974,511 | 12/1990 | Hsi-Chou | 101/38.1 |
| 5,450,791 | 9/1995 | Prohm | 101/333 |

FOREIGN PATENT DOCUMENTS 61-86263 A 5/1986 Japan .

2227671 8/1990 United Kingdom .

*Primary Examiner*—Edgar S. Burr
*Assistant Examiner*—Anthony H. Nguyen
*Attorney, Agent, or Firm*—Richard C. Litman

[57] ABSTRACT

A light-weight, portable golf ball marking device for golf balls is preferably shaped to resemble a golf ball balanced on a golf tee, and comprises a golf ball-shaped portion and a golf tee-shaped portion. The portions interconnect, and are both preferably manufactured from polypropylene. The ball-shaped portion comprises separate upper and lower halves, connected by a tether. The tee-shaped portion comprises separate front and back halves, which both define apertures for receiving a bolt and nut for securing the halves together. The bottom of the ball-portion insertably engages an opening defined by the tee-shaped portion to house the operational components of the golf ball marking device. The upper part of the tee-shaped portion defines a cavity that is continuous with this opening, and contains a tray-stem support member for an ink pad. The support member can be adjusted up or down, so as to accommodate ink pads having different thicknesses and maintain a constant height level. An absorbent blotter pad is affixed to the inner surface of the upper half of the ball-shaped portion, and engages the ink pad upon closure of the ball-shaped portion. A spring-actuated plunger circumferentially engages the stem, and stabilizes the ball in place during the marking process. Pressure exerted against the ball urges the plunger to retract, thus exposing the ink pad for marking a ball surface.

15 Claims, 3 Drawing Sheets

GOLF BALL MARKER

CROSS-REFERENCE TO RELATED APPLICATION

This application claims the benefit of Provisional U.S. patent application Ser. No. 60/015,264, filed Apr. 10, 1996.

BACKGROUND OF THE INVENTION

1. Field of the Invention

The present invention relates to golf ball marking devices, and more specifically to a light weight, portable ink stamping device having a novelty shape for marking golf balls.

2. Description of the Relevant Art

Existing golf ball printers and markers do not provide light weight portability, a highly desirable property when traversing a golf course. Further, many of the earlier inventions do not include structures that deliver ink to the surface of a golf ball, instead producing recessed impressions onto the surface thereof. The substantial force utilized by these devices for delivering impressions damages the precision balance of modern golf balls. While some of the more recently invented devices deliver inked imprints, they are mechanized and specifically adapted for use in manufacturing.

U.S. Pat. No. 849,600, issued to Cory on Apr. 9, 1907, describes a golf ball-marking device having movable jaws, which includes steel dies for delivering a recessed impression into the surface of a golf ball. This device, as used, can substantially alter the precision balance and shape of modern golf balls; moreover, it cannot be adapted to deliver ink. Performing a similar function, and exhibiting the same disadvantages, the device described in U.S. Pat. No. 1,286,205, issued to Beaver on Dec. 3, 1918, employs a screw threaded shank, steel dies, and a rotatable handle for delivering a clamping force for creating an identifying recessed impression. Likewise, U.S. Pat. No. 1,527,691, issued to McNab et al. on Feb. 24, 1925, describes a device that also employs substantial force and distorting pressure to deliver a recessed impression on to the surface of a golf ball.

U.S. Pat. No. 4,086,851, issued to Brandell on May 2, 1978, also describes a device that delivers a recessed impression when used on a golf ball. A cam-actuated ram delivers a cut impression on the surface of golf balls. This device and others described above, which create recessed cuts and impressions on the surface of a golf ball, destroy the aerodynamically-designed surfaces of modern golf balls. The surface dimpling is aerodynamically configured to increase lift and decrease airflow drag. The professional golfer properly shuns such devices that disfigure the aerodynamic features upon which he depends to provide the competitive advantage.

Several patents describe devices that employ movable jaws to combine delivery of a recessed impression with delivery of an inked imprint. U.S. Pat. No. 1,537,685, issued to Ladd on May 12, 1925, describes a device that resembles a hinged nutcracker. Metal types, which must be inked before use, are affixed to the inner surface of a pivoting jaw for delivering a recessed impression. Not only does this device deliver a potentially distorting pressure on a golf ball, but its numerous parts diminish portable use on a golf course. U.S. Pat. No. 1,814,170, issued to Long on Jul. 14, 1931, describes a device that also uses pivoting jaws to deliver an inked impression. A dual hinged, pivoting inking structure, with an ink holding member delivers ink to the surface of the metal types, requiring a mechanical re-inking step before every use, and lacking portability.

Several devices are specifically adapted to be used in the manufacturing process. These devices depend on mechanized power means to operate moveable dies or types. For example, U.S. Pat. No. 2,539,303, issued to Gerke et al. on Jan. 23, 1951, describes a method for imprinting a golf ball which includes a mechanically-driven die shaft that requires the die to be heated to 110° F. and the golf balls to be cooled below 50° F. before imprinting. Similarly, Japanese Patent 61-86263(A), published by Sumitomo Rubber Ind. Ltd. on May 1, 1986, describes a method for printing golf balls that utilizes two mechanically operated opposing dies and color ribbons. Further, a step is included which requires the ball be rotated 90° on a vertical axis so the device can print along the entire circumference of a golf ball. The detailed precision of this manufacturing method precludes its portability.

Furthermore, U.S. Pat. No. 4,974,311, issued to Hsi-Chou on Dec. 4, 1990, describes a motor powered device that determines the center of gravity on a golf ball and thereafter delivers indicia on the surface of the ball for assisting the golfer to properly hit the ball. U.K. Patent 2,227,671 A, published by Shaw and Machin on Aug. 8, 1990, describes the composition and manufacture of the outer layer of a golf ball. U.S. Design Patent Des. 249,089, issued to Studley on Aug. 22, 1978, shows the design of a golf ball printer; however, no printing mechanism is shown or enabled.

U.S. Pat. No. 5,450,791, issued to Prohm on Sep. 19, 1995, describes a golf ball marking device that has a housing containing a replenishable inking pad, accessed by a hinged port. Upon the housing are screw mounted removable plugs; the plug ends have printing projections. The plugs can be removed from the housing and used to stamp identifying marks on golf balls, but not before first opening the inkpad access port, and then, applying ink to the surface of the printing projections of the plug.

None of the above inventions and patents, taken either singularly or in combination, is seen to describe the instant invention as claimed.

SUMMARY OF THE INVENTION

The present invention is a light weight, portable golf ball marking device for printing on golf balls an identifying mark. The golf ball marker is preferably shaped to resemble a golf ball balanced on a golf tee, comprising a golf ball-shaped portion and a golf tee-shaped portion. The portions interconnect, and are both preferably manufactured from polypropylene. The ball-shaped portion comprises separate upper and lower hemispherical parts, or halves, connected by a tether. The tee-shaped portion comprises separate front and back halves containing apertures for receiving a bolt and nut for securing the halves together.

A substantially rectangular indentation along the tee-shaped portion provides a designated space for the name or initials of the owner of the golf ball marker. An eyelet defined by the bottom of the tee-shaped portion facilitates the hanging and storage of the golf ball marking device.

The bottom of the ball-portion insertably engages an opening defined by the top surface of the tee-shaped portion to house the operational components of the golf ball marking device. The upper part of the tee-shaped portion defines a cavity that is continuous with the opening defined by the top surface thereof. A nut housed within the cavity receives the threaded part of a stem. The top of the stem integrally connects to an ink pad tray in a perpendicular orientation. The ink pad tray supports an ink pad, having indicia thereon, for marking a golf ball surface. The threaded part of the stem can be adjusted up or down, so as to accommodate ink pads having different thicknesses and maintain a constant height level. An absorbent blotter pad is affixed to the inner surface of the upper half of the ball-shaped portion, and engages the ink pad upon closure of the ball-shaped portion.

A spring-actuated plunger circumferentially engages the top part of the stem. Before marking a golf ball, the ball-shaped portion is opened and the edge of the plunger is positioned so that it engages the ball surface and stabilizes the ball in place during the marking process. Pressure exerted against the ball urges the plunger deeper into the ball-shaped portion, thereby compressing the actuating spring. The plunger retracts to expose the ink pad, which can then contact the surface of the ball, and mark it. Upon removal of the plunger from the ball surface, the spring returns to its resting position. Closing the ball-shaped portion brings the absorbent blotter pad into contact with the inked surface of the ink pad.

Accordingly, it is a principal object of the invention to provide a light weight, portable golf ball marking device for printing on golf balls an identifying mark.

It is another object of the invention to provide a golf ball marking device that resembles a golf ball on a golf tee.

It is a further object of the invention to provide a portable golf ball marking device that stabilizes the ball in place during the marking process.

It is also an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
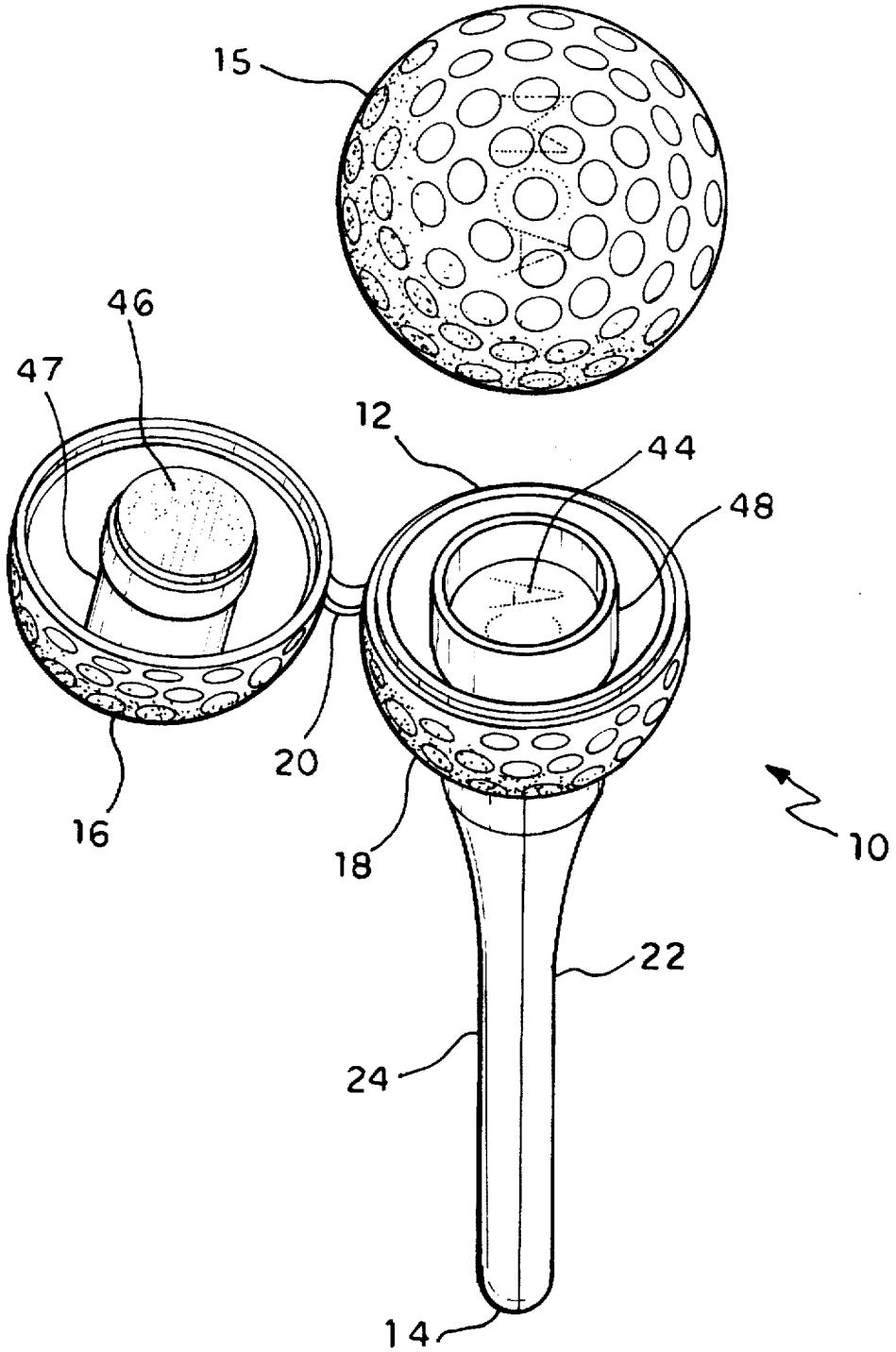
FIG. 1 is an environmental perspective view of the golf ball marking device of the present invention, with a golf ball marked thereby.
Figure 2:
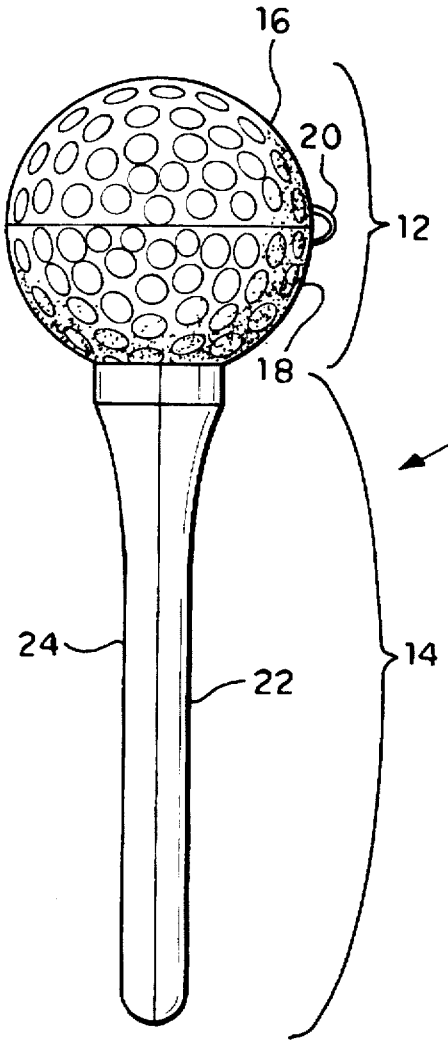
FIG. 2 is a side view of the golf ball marking device according to FIG. 1, in the closed position.
Figure 3:
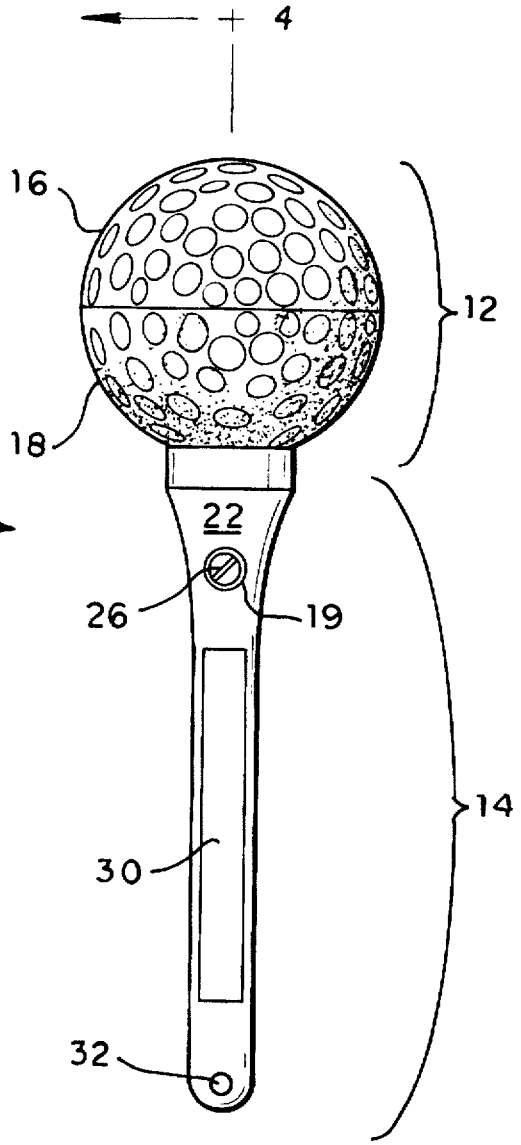
FIG. 3 is a front plan view of the golf ball marking device according to FIG. 1, in the closed position.

FIG. 1 shows the portable golf ball marking device of the present invention, referenced as 10 herein, and in use with a golf ball 15. In the preferred embodiment of the present invention, marking device 10 is manufactured so that it resembles a golf ball balanced on a golf tee, as illustrated in FIGS. 2 and 3. Accordingly, marking device 10 comprises a golf ball-shaped portion 12 and elongate platform or a golf tee-shaped portion 14. Ball-shaped portion 12 and elongated tee-shaped portion 14 interconnect, and are preferably manufactured from polypropylene.

Ball-shaped portion 12 comprises separate upper and lower hemispherical parts, or halves, 16,18 respectively. A tether 20 connects upper and lower halves 16,18, as shown in FIGS. 1 and 2.

Tee-shaped portion 14 comprises separate front and back halves 22,24, as shown in FIG. 2. Now referring to FIG. 4, a bolt 26 engages an aperture 27 defined by back half 24, to threadably engage a nut 28 within an aperture 29 defined by front half 22, ultimately securing front and back halves 22,24 together. Alternatively, bolt 26 engages aperture 29 to threadably engage nut 28 within aperture 27.

Front half 22 defines a substantially rectangular indentation along its length 30, as illustrated in FIG. 3, providing a designated space for the name or initials of the owner of the golf ball marker. Also, front and back halves 22,24, when secured together, define an eyelet 32 at the end of tee-shaped portion 14 farthest from ball-shaped portion 12. Eyelet 32 facilitates the hanging and storage of the golf ball marking device 10.

Figure 5:
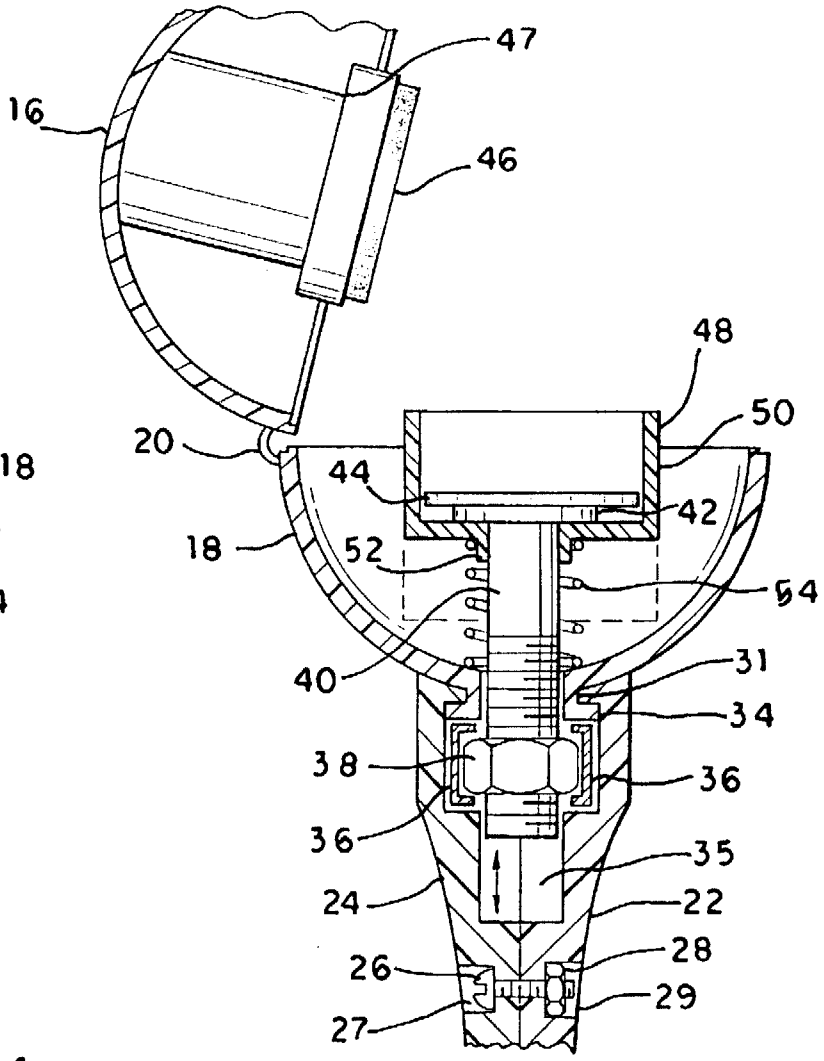
FIG. 5 is a cross sectional view of the golf ball marking device according to FIG. 1 in the opened position.
Figure 4:
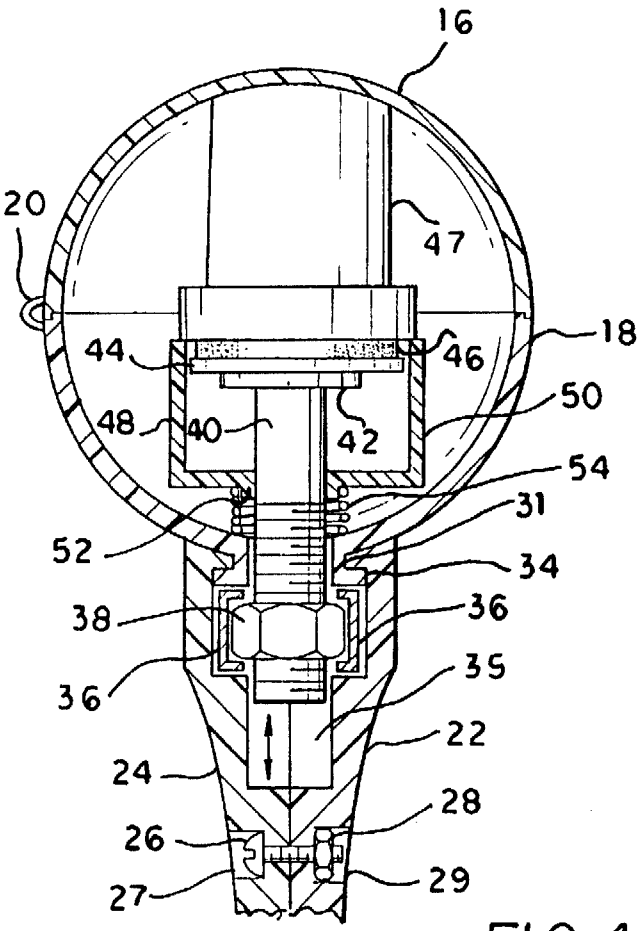
FIG. 4 is a cross sectional view of the golf ball marking device according to FIG. 1 in the closed position, drawn along line 4 in FIG. 3.

Now referring to FIGS. 4 and 5, the bottom of lower half 18 terminates in a substantially square anchor or base 31. Base 31 defines an aperture that extends through the bottom of lower half 18. Base 31 also integrally attaches to flanges 34 along the lower edge of two of its opposing sides. Flanges 34 insertably engage the opening defined by the top surface of tee-shaped portion 14. Lower half 18 and the upper part of tee-shaped portion 14 house the operational components of marking device 10. Specifically, the upper part of tee-shaped portion 14 defines a cavity 35 that is continuous with the opening defined by the top surface thereof. The widest part of cavity 35 contains a substantially cylindrical jacket 36, which in turn circumferentially engages a nut 38. Nut 38 receives the threaded part of a substantially cylindrical post or stem 40 that extends through the aperture defined by base 31 and into lower half 18. The top of stem 40 integrally connects to a substantially disc-shaped ink pad tray 42 so that tray 42 is oriented perpendicularly to stem 40. Ink pad tray 42 supports an ink pad 44, having indicia thereon, for marking a golf ball surface. Ink pad 44 is secured to ink pad tray 42 using an adhesive. The threaded part of stem 40 can be adjusted up or down, as indicated by the arrows of FIGS. 4 and 5, so as to accommodate ink pads having different thicknesses and maintain a constant height level. An absorbent blotter pad 46 engages a support post 47, which in turn integrally connects to the inner surface of upper half 16, so that ink pad 44 engages absorbent blotter pad 46 upon closure of the ball-shaped portion 12, as shown in FIG. 4.

A spring-actuated plunger 48 circumferentially engages the top part of stem 40. Plunger 48 comprises top and bottom cylindrical members 50,52. Bottom member 52, which engages the top part of stem 40, has an inner diameter slightly larger than the diameter of stem 40. Top member 50, which extends upward and surrounds ink pad 44, has an inner diameter slightly larger than the diameter of ink pad 44. Bottom member 52 insertably engages a spring 54. FIG. 5 illustrates the resting position of plunger 48. Before marking a golf ball, ball-shaped portion 12 is opened and the edge of top member 52 is positioned so that it engages the ball surface, and stabilizes the ball in place during the marking process. Pressure exerted against the ball urges plunger 48 deeper into lower half 18, thereby compressing spring 54. Plunger 48 retracts to expose ink pad 44, which can then contact the surface of the ball, and mark it with the indicia of ink pad 44. Upon removal of plunger 48 from the ball surface, spring 54 returns to its resting position. Closing ball-shaped portion 12 brings absorbent blotter pad 46 into contact with the inked surface of ink pad 44, as shown in FIG. 4.

It is to be understood that the present invention is not limited to the sole embodiment described above, but encompasses any and all embodiments within the scope of the following claims.

I claim:

1. A golf ball marking device comprising:

a hollow, spherical first portion comprising an upper half having an interior surface, a lower half and a tether, said tether connecting said upper half and said lower half, said lower half and said upper half when joined together defining an enclosed, interior first cavity, said lower half further defining a first aperture;

a blotting member comprising a support post having a first end attached to said inner surface of said upper half and a second end, and an absorbent blotter pad substantially perpendicularly connected to said second end;

an elongated portion having a top defining a second cavity for rotatably receiving a threaded stem, said second cavity aligned in registry with said first aperture of said lower half, said elongated portion attached to said first portion;

an inking member comprising a threaded stem and an ink pad tray bearing indicia for marking a golf ball surface with ink, said ink pad tray substantially perpendicularly attached to said threaded stem and forming a terminal flange thereon, said threaded stem received by said second cavity and extending through said first aperture into said first cavity of said lower half disposing said ink pad tray within said first cavity, said inking member being coaxially aligned and opposing said blotting member when said upper half and said lower half are joined together, said threaded stem being dimensioned to extend sufficiently into said first cavity to cause said ink pad to engage said blotter pad and permit axial extension by rotation of said threaded stem; and, a spring-actuated plunger comprising a cylindrical member having a floor having a diameter slightly larger that of said ink pad tray and a hole, said threaded stem closely and freely passing through said hole, and a spring coaxially surrounding said threaded stem, said spring having a first end engaging said lower half and a second end outwardly biasing said floor against said lower half thereby causing said cylindrical member to jacket said ink pad tray and said blotter pad when said upper half and said lower half are joined.

2. The golf ball marking device according to claim 1, wherein said second cavity includes a threaded nut in alignment with said first aperture.

3. The golf ball marking device according to claim 1, wherein the ink pad tray further includes a substantially disc-shaped ink pad impregnated with ink.

4. The golf ball marking device according to claim 1, wherein said ball-shaped portion and said tee-shaped portion are fabricated from polypropylene.

5. The golf ball marking device according to claim 1, wherein said elongated member comprises cooperating front and back halves having connecting means for securing said front half to said back half and disassembling of said elongated member.

6. The golf ball marking device according to claim 5, wherein said connecting means comprise a bolt, a nut and a channel defined in said front half and said back half together for receiving said bolt and nut.

7. The golf ball marking device according to claim 1, wherein said elongated member defines an eyelet at the end distal from said top for hanging of said golf ball marking device.

8. The golf ball marking device according to claim 1, wherein said elongated member defines an indentation for inscribing owner-identifying indicia thereon.

9. The golf ball marking device according to claim 1, wherein said lower half further includes a base comprising at least two flanges diametrically extending in opposing directions from said base and wherein further said second cavity of said elongated member is dimensioned and configured to mate with said base to removably anchor said spherical portion to said elongated portion.

10. The golf ball marking device according to claim 1, wherein said spherical member simulates a golf ball, and said elongate member simulates a golf tee.

11. A golf ball marking device comprising:

a hollow spherical enclosure, said enclosure comprising top and bottom halves, said bottom half defining an aperture at its substantial center and said bottom half integrally connecting to a substantially square anchor, said anchor peripherally engaging said aperture, and said anchor comprising two edge protrusions along two opposing sides thereof;

an elongate platform, said platform comprising a pair of mating pieces and means for securing said pieces together, said pieces having substantially bilateral symmetry and configured to define a cavity therebetween, said platform interlocking with said anchor and said edge protrusions retaining said bottom half in place so that said aperture is continuous with the top of said cavity;

an ink delivery system, said ink delivery system contained within said spherical enclosure and said platform and comprising:

a substantially circular ink pad, said pad impregnated with ink and bearing indicia for marking on a golf ball surface;

an ink pad support member, said support member comprising a substantially cylindrical post and a substantially disc-shaped plate, said plate integrally attached to said post and said post having treads along the lower part thereof;

a retractable plunger, said plunger slidably engaging said post and encircling said plate and said ink pad, including means for compressing said plunger within said bottom half, and;

means for adjusting said ink pad support member within said cavity to reside at different vertical positions, and;

an ink blotter system, said ink blotter system comprising a substantially circular ink blotter pad and a substantially cylindrical support member therefor, said support member integrally attached to the substantial center of said top half, and said blotter pad affixed to said support member so that said blotter pad engages said ink pad upon closure of the said spherical enclosure.

12. The golf ball marking device according to claim 11, wherein said spherical enclosure is manufactured to resemble a golf ball, and said elongate platform is manufactured to resemble a golf tee.

13. The golf ball marking device according to claim 11, wherein said means for securing said mating pieces together comprise apertures defined by each of said pieces and a bolt-screw assembly, said apertures connecting to form a continuous channel when said pieces are in alignment, said channel deposed below and separate from said cavity and said bolt-screw assembly insertably engaging said channel.

14. The golf ball marking device according to claim 11, wherein said means for compressing said plunger within said bottom half comprise a spring, said spring engaging said plunger and encircling said post.

15. The golf ball marking device according to claim 11, wherein said means for stabilizing said ink pad support member within said cavity at different vertical positions comprise a substantially cylindrical jacket and a bolt, said jacket disposed within said cavity and said jacket circumferentially engaging said bolt so that said bolt receives said threaded lower part of said post, enabling vertical displacement thereof to achieve multiple plate heights to compensate for varying ink pad thicknesses.

* * * * *